US006810709B2

(12) United States Patent
Hammar et al.

(10) Patent No.: US 6,810,709 B2
(45) Date of Patent: Nov. 2, 2004

(54) HEATED METAL FORMING TOOL

(75) Inventors: Richard Harry Hammar, Utica, MI (US); James Gregory Schroth, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/269,234

(22) Filed: Oct. 11, 2002

(65) Prior Publication Data

US 2004/0069039 A1 Apr. 15, 2004

(51) Int. Cl.[7] ..... B21D 37/16

(52) U.S. Cl. ..... 72/342.7; 72/342.92; 72/709; 219/483

(58) Field of Search ..... 72/342.1, 342.7, 72/342.8, 342.92, 342.94, 342.96, 462, 476, 709, 60, 61, 54, 57; 219/483, 484, 486, 602, 645, 672

(56) References Cited

U.S. PATENT DOCUMENTS 3,584,487 A * 6/1971 Carlson ..... 72/38
3,926,029 A * 12/1975 Abson et al. ..... 72/342.92
4,888,973 A * 12/1989 Comley ..... 72/342.92
5,214,949 A * 6/1993 Cadwell ..... 72/60
5,277,045 A * 1/1994 Mahoney et al. ..... 72/60
5,819,572 A 10/1998 Krajewski ..... 72/42
5,974,847 A 11/1999 Saunders et al. ..... 72/57
5,992,197 A * 11/1999 Freeman et al. ..... 72/62
6,047,583 A 4/2000 Schroth ..... 72/60
6,085,571 A 7/2000 Brinas et al. ..... 72/420
6,091,063 A * 7/2000 Woods ..... 219/645
6,253,588 B1 7/2001 Rashid et al. ..... 72/57
6,272,894 B1 * 8/2001 Hudson et al. ..... 72/61
6,305,202 B1 10/2001 Kleber ..... 72/57
6,322,645 B1 * 11/2001 Dykstra et al. ..... 148/520
6,550,302 B1 * 4/2003 Ghosh ..... 72/342.8

* cited by examiner

*Primary Examiner*—Ed Tolan
(74) *Attorney, Agent, or Firm*—Kathryn A. Marra

(57) ABSTRACT

A heated metal forming tool including an un-heated mounting plate that is attached to a press. A tool detail is attached to the mounting plate. Insulation surrounds the tool detail to thermally isolate it from the mounting plate, and from the tool surroundings. The tool detail is heated internally by heaters disposed in zones within the tool detail. The temperature of various portions of the tool detail can be independently controlled by varying the temperature within any of the zones.

20 Claims, 2 Drawing Sheets

HEATED METAL FORMING TOOL

TECHNICAL FIELD

This invention relates to a heated metal forming tool, and more particularly the invention relates to a heated metal forming tool for a hot blow forming, superplastic, or quick plastic forming operation.

BACKGROUND OF THE INVENTION

Automobile body panels are typically made by forming low carbon steel or aluminum alloy sheet stock into desired panel shapes. Sheet panels may be made using conventional room temperature technologies such as stamping or sheet hydroforming. Sheet panels can also be made from elevated temperature forming technologies such as superplastic forming (SPF) processes and quick plastic forming (QPF) processes. The above-referenced high-temperature forming processes have the advantage of creating complex shaped parts from a single sheet of material. Such forming processes facilitate component consolidation, and allow an overall panel assembly to be manufactured with fewer panels and joints than would be possible if panels were formed with conventional stamping processes.

Superplastic forming processes generally utilize a metal alloy, for example, aluminum or titanium alloys that have high ductility when deformed under controlled conditions. Such metal alloys are capable of extensive deformation under relatively low shaping forces. Superplastic alloys are generally characterized by having tensile ductility in the range from 200 to 1,000 percent elongation. Generally, such a process involves heating an aluminum alloy sheet to a forming temperature in the range of from 400° C. to 510° C. and then stretch forming the sheet against a forming tool utilizing high-pressure gas.

Typical superplastic forming operations utilize low material deformation rates and consequently require slow press cycles such as 20 to 60 minutes to form shaped parts. However, high production requirements typically associated with automobile manufacturing would not allow for cycle times in the 20 to 60 minute range, as they would be economically unfeasible. Therefore, there is a need in the art for a metal forming process and associated tooling that can produce complex shaped parts with a lower cycle time.

SUMMARY OF THE INVENTION

There is disclosed a heated metal forming tool that includes an un-heated mounting plate attached to a press. There is also included a tool detail that is attached to the mounting plate. Insulation surrounds the tool detail to thermally isolate it from the mounting plate. The tool detail includes a plurality of heaters that are disposed in zones within the tool detail such that the temperature of various portions of the tool detail can be independently controlled.

The heated metal forming tool of the present invention has the advantage of providing a heated metal forming tool that is capable of maintaining a uniform temperature distribution, such that the cycle time of a forming process is decreased.

The heated metal forming tool of the present invention, has the further advantage of providing a tool including a plurality of heaters in zones such that the temperature of various portions of the tool can be independently controlled to maintain a uniform temperature gradient within the tool detail.

The heated metal forming tool of the present invention has the additional advantage of providing a tool that is thermally efficient, such that the energy needed to maintain the tool at the working temperature is lower than that used in heated-press systems.

The heated metal forming tool of the present invention has the additional advantage of providing a tool with a cool (<130 F) exterior, such that other equipment may be placed in close proximity without being affected by high temperatures, and press operators can touch the tool exterior without injury.

DESCRIPTION OF THE PREFERRED EMBODIMENTS

Figure 1:
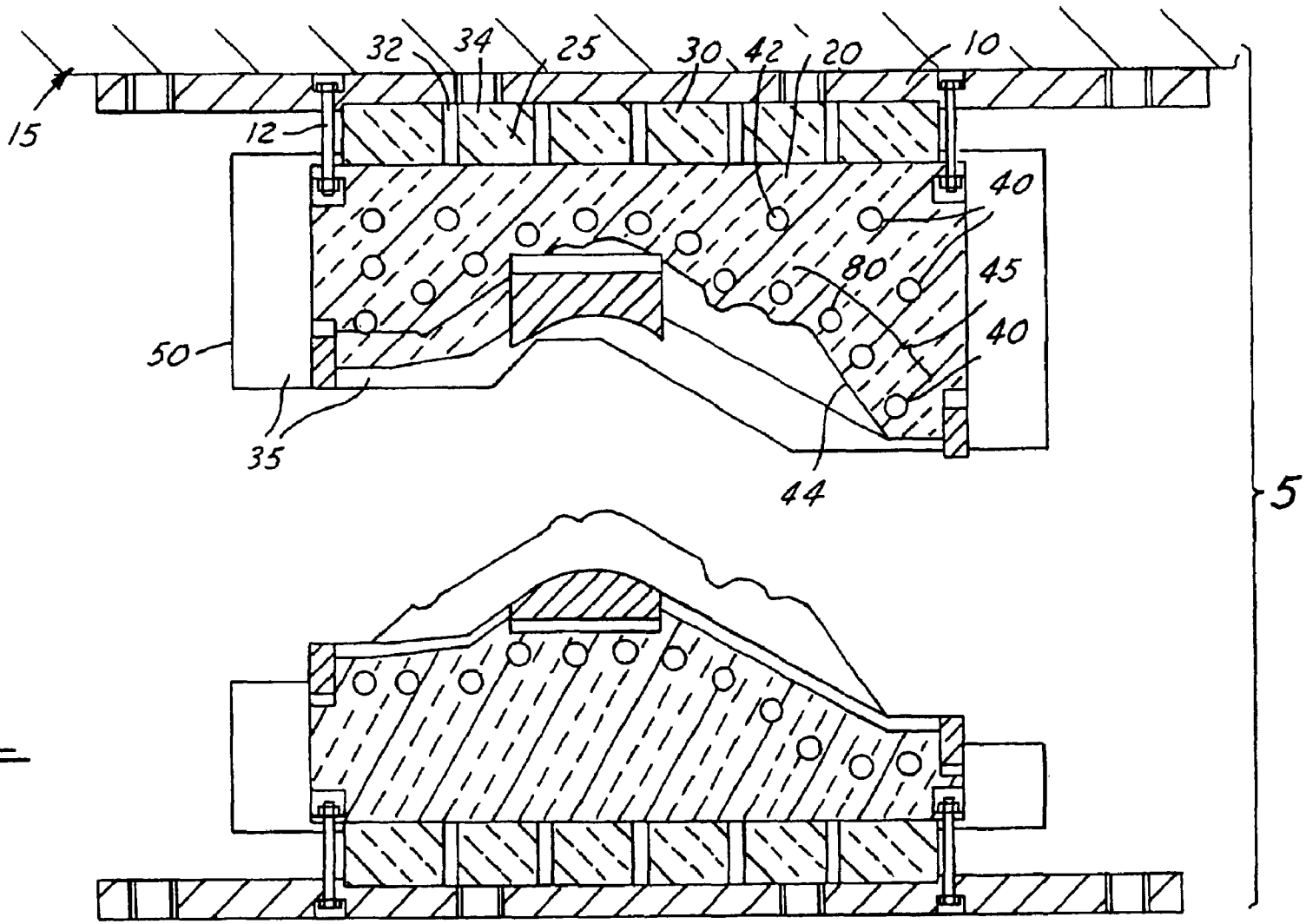
FIG. 1 is a side view of the heated metal forming tool of the present invention.

With reference to FIG. 1, there is shown the heated metal forming tool 5 of the present invention. An un-heated mounting plate 10 is attached to a press 15 for opening and closing the metal forming tool 5. A forming tool detail 20 is attached to the mounting plate 10 with fasteners 12. The tool detail includes insulation 25 attached to the tool detail 20. The insulation 25 can be classified as load-face insulation 30 positioned between the mounting plate 10 and the forming tool detail 20 and peripheral insulation 35 attached around the periphery of the forming tool detail 20.

The forming tool detail 20 is preferably constructed of a solid material to maximize the heat transfer from the plurality of heaters 40 to the forming tool detail 20. The forming tool detail 20 may be constructed of a tool grade steel that exhibits durability at the forming temperatures of a superplastic or quick plastic forming operation, as outlined in the background section. Preferably, the forming tool detail is constructed of P20 Steel that is readily available in large billets to accommodate a large forming tool. The initial forged steel billet is machined to form a curved detail specific to the part being produced by the heated metal forming tool 5. P20 Steel is also utilized in that it may be readily weld repaired and refinished, as opposed to higher carbon material compositions which are more difficult to weld repair and refinish.

The mounting plate 10 is preferably formed of standard structural plate steel, such as ASTMA36. The tool detail 20 is attached to the mounting plate 10 by appropriate fasteners 12. The fasteners 12, are preferably formed of heat resistant alloys, such as RA330 or other suitable heat resistant and load bearing alloys.

With reference to FIG. 1, the tool detail 20 includes bores 80 formed therethrough in which a plurality of heaters 40 are disposed. As referenced above, the plurality of heaters 40 are arranged in zones 45, as represented in FIG. 1, wherein the zones comprise adjacent heaters as represented in the side view. It is to be understood that other combinations of the plurality of heaters 40 may be utilized in creating the zones 45 of the present invention. For example, the heaters 40 on a periphery of the tool may comprise a zone 45 having a different control temperature than heaters 40 in the center of the tool detail 20. The zones 45 within the tool detail 20 are capable of independent control such that temperatures of various portions of the tool detail 20 can be adjusted. The plurality of heaters 40 are preferably controlled by monitoring thermocouples (not shown) placed near the working surface within a specific zone 45. The majority of the plurality of heaters 40 are placed near the tool detail surface as represented by the numeral 44. Other heaters of the plurality of heaters 40 are placed farther below the working surface of the tool detail within deep regions as represented by the numeral 42 of the tool detail. The placement of the heaters in such an orientation, ensures that the operating surface of the metal forming tool is maintained at a uniform temperature, as well as the deeper regions of the tool along a theoretical Z axis. The uniformity of the temperature throughout the tool detail 20 encourages more uniform tool heating as well as prevents warping during tool heat-up and at the elevated operating temperature.

The fundamental goal in the design of the heating system including the placement of the plurality of heaters 40, as well as controlling the temperature of the plurality of heating elements 40 in various zones 45 is to distribute the heat that is developed locally in the heating elements evenly over large portions of the tool. A successful balance results in a uniform temperature through all three dimensions of the forming tool detail. For example, it is known that heat is lost primarily through the outer edges of the tool; therefore, a greater temperature or more heat must be introduced near the tool exterior than within the tool interior. In this effort, various of the plurality of heating elements 40 in the theoretical X and Y dimensions of the tool, may be manufactured such that greater heat input is provided for the outside edges of the tool detail.

In a preferred embodiment, the plurality of heaters 40 comprise resistance heaters attached to a closed loop proportional-integral-derivative controller which can be utilized to maintain specified temperatures within each of the tool zones 45. In such a system, the electrical input to various of the plurality of heaters 40 can be adjusted to vary the temperature in a specified zone 45.

Figure 2:
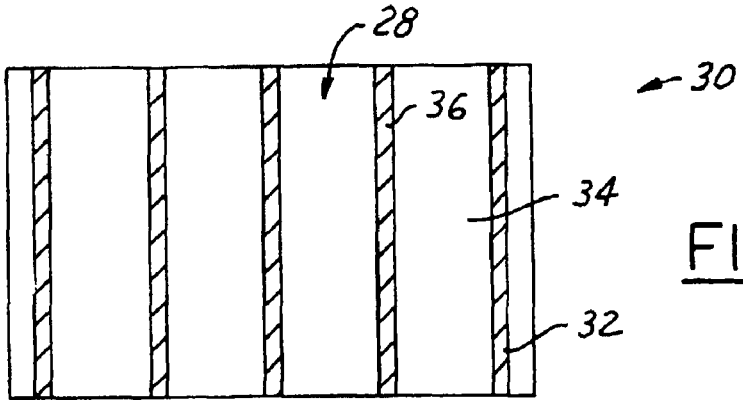
FIG. 2 is a plan view of the bottom insulation detailing the load bearing and non-load bearing insulation.

With reference to FIG. 1, the heated metal forming tool 5 of the present invention includes insulation 25 surrounding the forming tool detail 20. The insulation 25 can be classified into two categories including load-face insulation 30 and peripheral insulation 35. The load-face insulation 30 includes a combination of load bearing 32 and non-load bearing 34 insulation. With reference to FIG. 2, there is shown a plan view detailing the orientation of the load-face insulation 30. As can be seen, the load bearing insulation 32, generally in the shape of slabs or pillars 36, are spaced from each other and positioned between the tool detail 20 and the mounting plate 10. The spacing between the load bearing pillars 36 is filled with non-load bearing insulation 34.

The load bearing insulation 32 may be formed of any of the following including high load bearing ceramics, high load bearing composites, inconel alloys, and various austenitic steels. A preferred load bearing insulation is a ceramic composite material, Zircar RS-100 or Zircar RS-1200, produced by the Zircar Corporation. The non-load bearing insulation is preferably a blanket insulation that is capable of withstanding the elevated temperature of the forming tool. A preferred blanket insulation is Cer-wool RT commercially available from Vesuvius, USA. The load-face insulation 30 isolates the high-temperature forming tool detail 20 from the mounting plate 10 to maintain a high temperature within the tool detail 20, as well as to maintain a lower ambient temperature on the outside of the forming tool.

Figure 3:
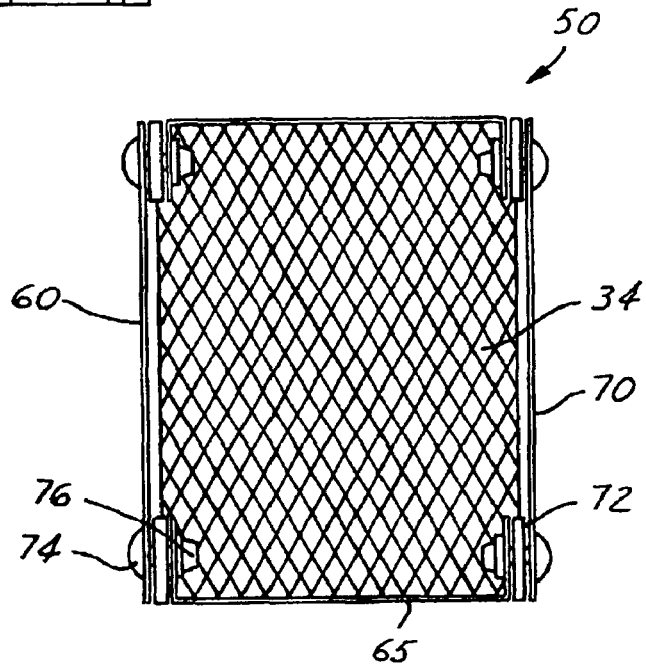
FIG. 3 is a sectional view of the non-load bearing insulation enclosures.

The peripheral insulation 35 generally comprises non-load bearing insulation 34 as that detailed above, that is encapsulated in enclosures 50 that allow for thermal expansion. The enclosures 50 are attached to the tool detail 20 around its periphery. The enclosures 50 are generally formed of stainless steel plates surrounding an inner core of non-load bearing insulation 34. In a preferred embodiment, the enclosures 50 comprise a three-piece apparatus including an inner cover 60, a surround 65, and an outer cover 70. With reference to FIG. 3, there is shown the inner core of non-load bearing insulation 34 surrounded by a surround 65 having double flanges for enclosing the non-load bearing insulation 34. On top of that is placed, non-heat conductive separators 72, such as woven glass tape to separate the surround 65 from the inner cover 60. Again, the surround 65 is separated from the outer cover 70 by non-heat conductive elements 72. In this manner, the inner and outer covers are thermally isolated from the rest of the enclosure 50 such that heat transfer between the various components is minimized. The outer covers 60 and 70 in a preferred embodiment, are attached with machine screws 74 which are passed through slotted holes and attached to a nut 76 such that they allow for relative motion between the various components of the enclosure 50.

Figure 4:
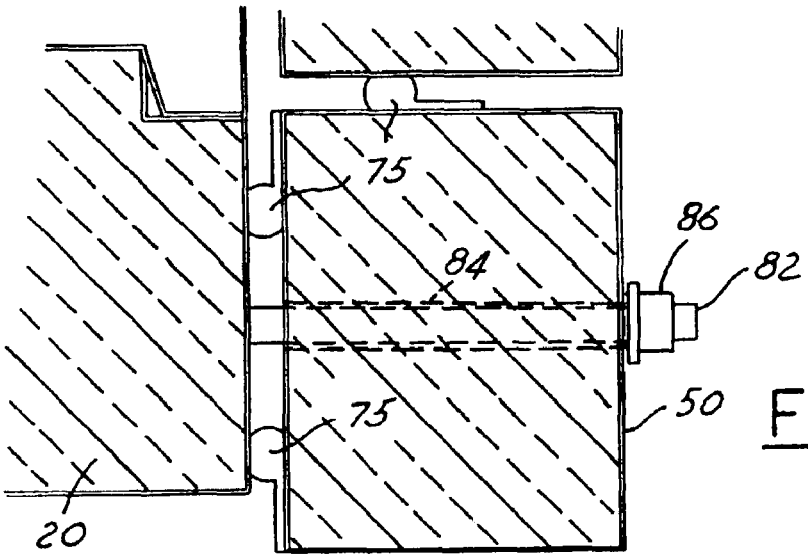
FIG. 4 is a side sectional view of the non-load bearing enclosures mounted on the tool detail.

With reference to FIG. 4, there is shown the peripheral insulation enclosures 50 attached to the tool detail 20. As can be seen, tadpole seals 75 are attached to the outer surfaces of the enclosures 50 that mate with the tool detail 20 as well as adjacent enclosures 50. The tadpole seals 75 limit the convective air currents between the tool detail 20 and the peripheral insulation 35 which is made up of the various enclosures 50. In a preferred embodiment, the insulation closures 50 are attached to the tool detail 20 on threaded rods 82 projecting from an outside surface of the tool detail 20. The rods 82 are passed through hollow cylindrical inserts 84 that are welded into the insulation enclosures 50. The enclosures 50 are then affixed with a washer and nut 86 applied to the end of the threaded rods 82.

As outlined above, the heated metal forming tool 5 is internally heated, such that a heated press including a heated mounting plate is not necessary. By eliminating the need for a heated press, cycle times for the press can be decreased, as the cumbersome insulation has been removed from the press. The forming tool 5 of the present invention also includes insulation disposed around the tool detail for maintaining a temperature of the tool detail 20, as well as providing a barrier to elevated temperatures on an exterior of the tool such that equipment may be placed in proximity to the forming tool without exposure to excessive heat. The tool detail 20 of the present invention may be removed from the press while at the forming temperature due to the insulation surrounding the tool detail which limits the exterior temperature of the detail. In this manner, the tool detail can be removed while still at an elevated temperature and a second preheated tool installed in the press.

The positioning of the internal heating elements 40 as well as the control of the temperature in various zones 45 in conjunction with the insulation provides a tool detail 20 that maintains a uniform temperature without large temperature gradients commonly found in press heated forming tools. As such, the cycle times of the internally heated forming tool can be decreased significantly due to the uniform temperature.

While preferred embodiments are disclosed, a worker in this art would understand that various modifications would come within the scope of the invention. Thus, the following claims should be studied to determine the scope and content of this invention.

What is claimed is:

1. A heated metal forming tool comprising:

a mounting plate attached to a press;

a tool detail attached to the mounting plate, the tool detail comprising a thermally conductive metal body with a forming surface for a sheet metal workpiece at a superplastic forming temperature for said workpiece, the tool detail having insulation associated therewith and being thermally insulated from said mounting plate;

said body and forming surface of the tool detail being heated by a plurality of heaters disposed in zones within said body wherein a temperature of various portions of the tool detail may be independently controlled, said heaters being the sole heating source for said tool detail.

2. The heated metal forming tool of claim 1 wherein the mounting plate and press are un-heated.

3. The heated metal forming tool of claim 1 wherein the tool detail is formed of solid low carbon steel or cast iron.

4. The heated metal forming tool of claim 3 wherein the steel comprises P20 steel.

5. The heated metal forming tool of claim 1 wherein the insulation comprises peripheral insulation around the tool detail and load-face insulation positioned between the tool detail and the mounting plates.

6. The heated metal forming tool of claim 5 wherein the load-face insulation comprises load bearing and non-load bearing insulation.

7. The heated metal forming tool of claim 6 wherein the load bearing insulation comprises pillars or slabs spaced from each other and positioned between the tool detail and the mounting plate.

8. The heated metal forming tool of claim 7 wherein the spaces between the load-bearing pillars or slabs is filled with non-load bearing insulation.

9. The heated metal forming tool of claim 6 wherein the load bearing insulation is selected from the group consisting of: high load bearing ceramics, high load bearing composites, inconel alloys, and austenitic steel.

10. The heated metal forming tool of claim 6 wherein the non-load bearing insulation comprises blanket insulation.

11. The heated metal forming tool of claim 5 wherein the peripheral insulation comprises non-load bearing insulation encapsulated in enclosures that allow for thermal expansion and are attached to the tool detail.

12. The heated metal forming tool of claim 11 wherein the enclosures are formed of stainless steel sheet.

13. The heated metal forming tool of claim 11 wherein the enclosures comprise a three piece apparatus including an inner cover, a surround and an outer cover.

14. The heated metal forming tool of claim 13 wherein the inner cover, surround, and outer cover are thermally isolated from each other for reducing heat transfer.

15. The heated metal forming tool of claim 11 wherein the peripheral insulation further includes tadpole seals attached thereon for limiting convective air currents between the tool detail and the peripheral insulation.

16. The heated metal forming tool of claim 1 wherein said metal body of the tool detail includes bores formed therein for housing the plurality of resistance heaters.

17. The heated metal forming tool of claim 16 wherein the bores formed within said metal body of the tool detail are positioned such that the plurality of heaters maintain a uniform temperature distribution in all three dimensions of the tool detail.

18. The heated metal forming tool of claim 1 wherein the plurality of heaters comprise resistance heaters.

19. The heated metal forming tool of claim 1 wherein the plurality of heaters includes thermocouples associated therewith for controlling a temperature within a zone.

20. The heated metal forming tool of claim 1 wherein the temperature within a zone is controlled such that there is an even temperature distribution within the tool detail.

* * * * *